US005082397A

United States Patent [19]

Raviv

[11] Patent Number: 5,082,397

[45] Date of Patent: * Jan. 21, 1992

[54] METHOD OF AND APPARATUS FOR CONTROLLING FLUID LEAKAGE THROUGH SOIL

[75] Inventor: Avi Raviv, Rehovot, Israel

[73] Assignee: Solmat Systems, Ltd., Yavne, Israel

[ * ] Notice: The portion of the term of this patent subsequent to Nov. 22, 2005 has been disclaimed.

[21] Appl. No.: 217,860

[22] Filed: Jul. 12, 1988

Related U.S. Application Data

[63] Continuation of Ser. No. 866,715, Jul. 14, 1986, Pat. No. 4,786,208, which is a continuation of Ser. No. 730,257, May 6, 1985, Pat. No. 4,636,112, which is a continuation of Ser. No. 367,886, Apr. 13, 1982, abandoned.

[51] Int. Cl.[5] ..... B02B 3/16; F16L 1/028

[52] U.S. Cl. ..... 405/176; 405/38; 405/179; 405/270

[58] Field of Search ..... 405/38, 176, 129, 174, 405/179, 258, 270

[56] References Cited

U.S. PATENT DOCUMENTS 1,787,902 1/1931 Herfort .
1,803,838 5/1931 Carpenter .
3,309,875 3/1967 Niederwemmer .
4,098,089 7/1978 Zaslavsky et al. .
4,154,549 5/1979 Zalavsky et al. .
4,430,021 2/1984 Wagner et al. ..... 305/129
4,636,112 1/1987 Raviv .
4,786,208 11/1988 Raviv ..... 405/270 X

FOREIGN PATENT DOCUMENTS 718530 2/1980 U.S.S.R. .

*Primary Examiner*—David H. Corbin
*Attorney, Agent, or Firm*—Sandler, Greenblum & Bernstein

[57] ABSTRACT

Fluid leakage through soil in a region thereof is controlled by sequentially passing over the region to dig a plurality of parallel, laterally displaced grooves in the surface. Soil dug from each groove is temporarily stored, and a strip of sheet material is laid over a groove as it is created during each pass, the width of the strip being greater than the width of the groove. Thereafter, the temporarily stored soil is deposited on the strip such that it is covered with soil except along one edge, the other edge of the strip overlying the uncovered edge of an adjacent strip laid down during a previous pass over the region. As a consequence, a first layer of overlapping strips of sheet material covered with soil is installed over the region.

17 Claims, 2 Drawing Sheets

METHOD OF AND APPARATUS FOR CONTROLLING FLUID LEAKAGE THROUGH SOIL

This is a continuation of application Ser. No. 866,715 filed July 14, 1986, now U.S. Pat. No. 4,786,20 which in turn is a Continuation under 37 C.F.R. 1.60 of prior application Ser. No. 730,257, filed May 6, 1985, now U.S. Pat. No. 4,636,112, which is a Continuation under 37 C.F.R. 1.62 of prior application Ser. No. 367,886, filed Apr. 13, 1982, now abandoned.

FIELD OF THE INVENTION

This invention relates to a method of and apparatus for controlling fluid leakage through soil, and is particularly useful for sealing the bottom of an artificial pond such as a solar pond during its construction.

DESCRIPTION OF PRIOR ART

Construction of large-scale artificial solar ponds whose area measures in the millions of square meters, requires sealing large land areas against fluid leakage. Such ponds usually have a three-layer regime: at the surface, a convective, wind-mixed layer of brackish water of from 3–5 percent salinity some 30–50 cm deep; an intermediate non-convective layer about 1 meter in depth in the form of a halocline whose salinity increases from about 5 percent at the top to about 30 percent near the bottom; and a lower heat storage layer from 3–5 m. deep with a uniform salinity of about 30 percent. Solar radiation incident on the surface of the pond is absorbed in the various layers creating a temperature profile in the pond that matches the salinity profile, the halocline serving to insulate the heat storage layer from conductive heat loss to the atmosphere. By known techniques, heat in the heat storage layer can be extracted and used for producing electricity.

With millions of cubic meters of. high-salinity water at from 80°–90° C. in the pond, economic and ecological considerations require the bottom of the pond to be sealed against fluid leakage. One conventional technique for controlling leakage through soil involves constructing a liner by overlapping strips of rubberized sheet material and bonding the seams in situ. This is a technique that is very expensive in materials and labor. Another technique suggested in the prior art is to lay overlapping plastic sheets, of polyethylene, for example, on the surface to be protected, and to cover the strips with a shallow layer of soil. By laying another layer of overlapping strips of sheet material on top of the layer of soil in such a way that the seams in the second layer are staggered with respect to the seams of the first layer, and then covering the second layer with a shallow layer of soil, an effective seal is created. A reliable seal against leakage is provided, because any holes in the plastic layers are likely to be horizontally displaced, and the soil trapped between the two plastic layers acts as a flow resistor that effectively severely limits leakage.

The problem with this last-mentioned technique lies in the time and expense in applying it to a large area, primarily because it is a labor-intensive technique by reason of the problems in driving largescale earth-moving equipment directly on the sheet material. Other conventional techniques might be faster, but the quality of the seal obtained over large areas remains to be determined. For example, U.S. Pat. Nos. 4,098,089 and 4,154,549 disclose an arrangement in which a hollow cutting blade containing a supply of sheet material is dragged through the soil at a predetermined depth as sheet material is fed through an opening in the blade rearwardly of its cutting edge so that the soil effectively, is lifted over the blade and onto the sheet material that trails the blade. This approach has the advantage of mechanization, but control of the depth of the blade is extremely difficult, and the power required to move the blade as it traverses large expanses is difficult to control. Furthermore, this technique does not permit the edges of adjacent strips of sheet material to be overlapped, and the quality of the seal achieved even if it were possible to have overlying layers of sheet material remains to be proven.

A possible arrangement to avoid these problems is shown in U.S. Pat. No. 3,309,875 which discloses a tractor type of vehicle with a bucket elevator at its front for digging a shallow trench in the ground as the vehicle traverses a region. Soil dug by the bucket elevator is conveyed rearwardly on the vehicle and deposited near the rear thereof on top of a strip of sheet material unrolled from a carrier mounted in the vehicle behind the bucket elevator. This arrangement is simpler than the arrangement shown in the '089 patent, and is amenable to laying strips over a large land area; but it suffers from the same problem as the '089 patent in that the edges of the strips cannot be overlapped, and installation of overlying layers using this type of equipment does not appear to be practical.

Thus, the prior art does not disclose a technique adapted to mechanization which will control fluid leakage over large land areas by the installation of overlapping strips of sheet material in multiple layers. It is therefore an object of the present invention to provide a new and improved method of and apparatus for controlling fluid leakage which does not suffer from the deficiencies of the prior art.

DESCRIPTION OF INVENTION

According to the present invention, fluid leakage through soil in a region is controlled by sequentially passing over the region and digging a plurality of parallel, laterally displaced grooves in the surface, removing and temporarily storing the soil dug from a groove as it is created laying over a groove during each pass a strip of sheet material wider than the groove, and depositing the temporarily stored soil onto the strip such that the latter is covered with earth except along one edge, the other edge of the strip overlying the uncovered edge of an adjacent strip laid down during a previous pass over the region whereby a first layer of overlapping strips of sheet material covered by soil is installed over the region.

The spacing between grooves is selected such that one edge of a subsequently-laid strip can directly engage the uncovered edge of a previously-laid strip to form a seam. The seal at the seam is enhanced by using compressed air to clear any soil form the overlap region just ahead of the newly-laid strip.

The present invention can be carried out conveniently by conventional earth-moving equipment in the form of a scraper mechanism having a bowl with a trailing wheel support, and a leading scraper blade selectively engagable with the surface of the ground for scraping a groove therein when the mechanism traverses the ground, the scraped soil being deposited in the bowl. Scraper mechanisms of this type are well known in the art, and can contain an elevator for raising the scraped soil into the rear portion of the bowl. An example of such a conventional mechanism is the No. 633D elevating scraper manufactured by Caterpillar Tractor Company. This conventional mechanism can be modified in accordance with the present invention by attaching a roll of plastic sheet material to the mechanism, the sheet material being wider than the width of the scraper blade, and the axis of rotation of the roll being parallel to the axis of rotation of the trailing wheel support. As the mechanism scrapes a groove, a strip of sheet material is unrolled from the roll over the groove. By mounting a spreader on the mechanism, soil lifted by the elevator of the mechanism can be distributed nonuniformly across the width of the strip, so that one edge thereof remains uncovered.

The advantage of this arrangement lies in the simplicity of modification required of a conventional elevating scraper; namely, attaching a roll of sheet material to the rear of the scraper, and providing a spreader that carries the soil scraped by the scraper blade up, over, and behind the axle of the trailing wheel mount. Alternatively, the roll of sheet material can be located between the trailing wheel support and the scraper blade; in this case, a spreader is provided that guides the soil scraped by the scraper blade over the roll of sheet material in order to deposit the soil behind the roll and in front of the trailing wheel support. Thus, the trailing wheel support rides on soil deposited on top of the strip by the spreader thus protecting the sheet material from direct contact with the wheel support.

In one form of the invention, the soil is spread substantially uniformly deep on the strip; and in order to provide an overlying layer of sheet material, extra soil is mounded on the overlapped regions of the strips. Thereafter, the process described above is repeated in that the mounds are sequentially passed over in a direction along the length thereof to dig soil therefrom and to lay a strip of sheet material over the scraped mound. The soil scraped from a mound is deposited on the strip such that the scraped mound is covered with soil except along one edge of the strip, with the other edge of the strip overlying the uncovered edge of an adjacent strip laid down during a previous pass over an adjacent mound. Thus, a second layer of overlapping strips of sheet material is laid down over the first layer of overlapping strips, and the seams in the second layer are staggered with respect to the seams in the first layer.

Alternatively, the soil removed when the first groove is dug can be spread nonuniformly across the width of the strip in such a way that there is less soil in the center region of the strip as compared to the peripheral regions, whereby a mound of earth is created at the overlap of adjacent strips. This avoids the need to bring in extra soil after the first layer has been laid down, and before the second layer is laid down.

BRIEF DESCRIPTION OF DRAWINGS

Embodiments of the invention are described below by way of example, and with reference to the accompanying drawings, wherein.

DETAILED DESCRIPTION

Figure 1:
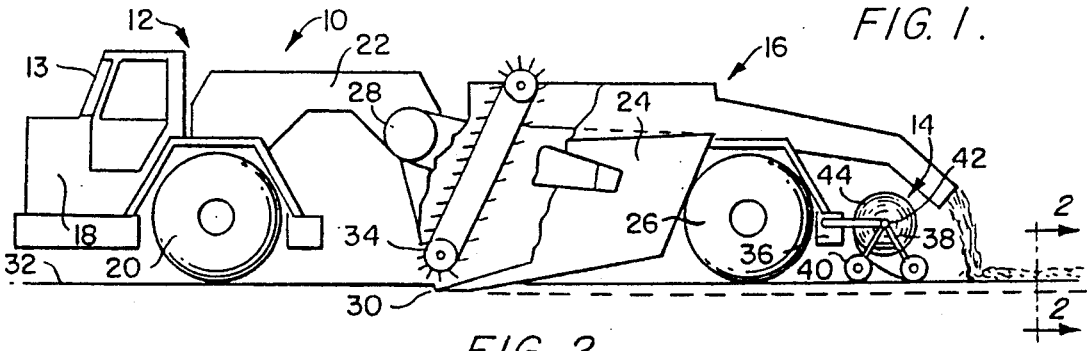
FIG. 1 is a side view, with parts broken away, of a conventional elevating scraper into which the present invention is incorporated.

Referring now to FIG. 1, reference numeral 10 designates one embodiment of apparatus according to the present invention for controlling fluid leakage through soil. Apparatus 10 comprises a conventional elevating scraper 12 such as a 633D elevating scraper manufactured by Caterpillar Tractor Company to which sheet-feeding mechanism 14 and spreader mechanism 16 are attached Elevating scraper 12 comprises tractor 18 containing operator housing 13, an engine (not shown) for powering drive wheels 20, and controls (not shown) for controlling the application of power to the drive wheels. Cushion hitch and goose neck 22 connects the tractor to bowl 24 of the scraper, which is supported by trailing wheel support 26 through hitch connection 28.

By reason of the controls of the scraper, the bowl 24 can be raised or lowered so that scraper blade 30 can be brought into selective engagement with the surface 32 of the ground. By lowering the scraper blade into the surface of the ground, soil is scooped into the bowl in the space just below the lower reach of elevator 34 which is mounted in the scraper mechanism.

The mechanism described above is entirely conventional in nature; and in its usual operation, the operator makes a pass of a region by powering wheels 20 after lowering the scraper blade 30 into the ground to a predetermined depth. Soil scraped into the bowl is loaded in the rear portion thereof with the assistance of elevator 34, whose speed is controlled by the operator.

In addition to elevating scraper 12, apparatus 10 according to the present invention includes roll mechanism 14 attached to the rear bumper 36 of the scraper. Mechanism 14 may be suspended from the bumper, or may include A-shaped frame 38, which carries ground-engaging wheels 40 supporting axle 42, on which a roll of sheet material, such as polyethylene, is mounted. The axis of rotation of roll 44 is parallel to the axle of trailing wheel support 26.

Figure 9:
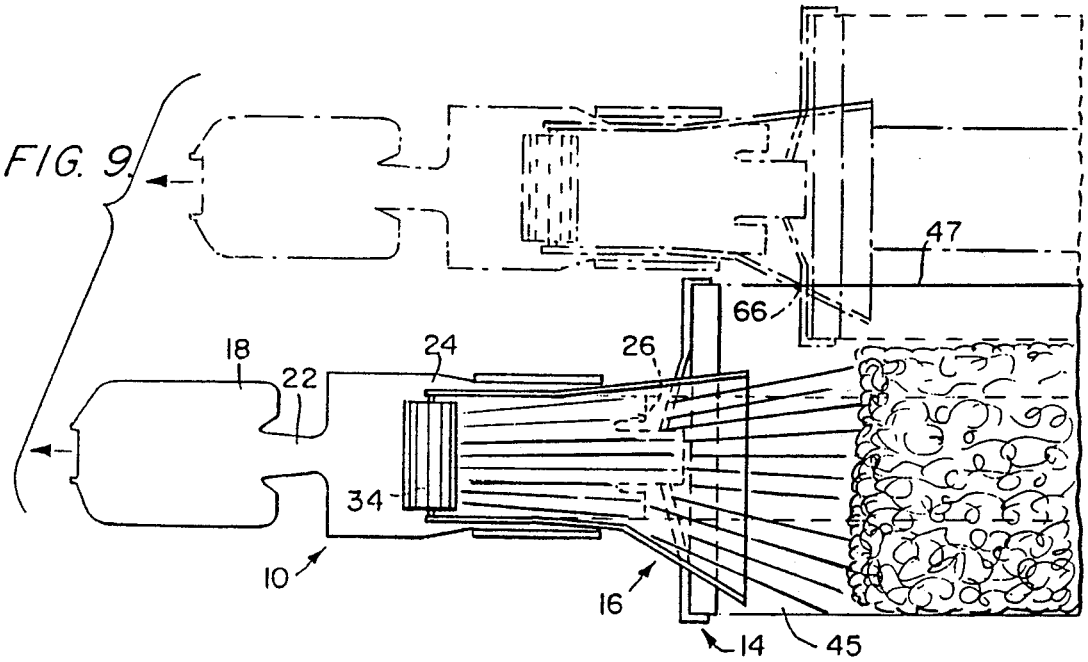
FIG. 9 is a top view of the apparatus shown in FIG. 8 in operation, showing the manner in which overlapping of the strips is carried out in sequential passes over the region to be treated.

Finally, mechanism 10 includes spreader 16, which guides soil lifted by elevator 34 over the axles of the trailing wheel mount and deposits the soil to the rear of mechanism 14 for the purpose of distributing the soil onto the top of the strip of sheet material as it is unrolled from roll 44. As shown in FIG. 9, the width of the roll exceeds the width of scraper blade 30; and the function of spreader 16 is to distribute the soil removed from the groove scraped by the scraper mechanism across the width of the strip. In general, spreader 16 distributes the soil on strip 45 in such a way that an edge of the strip, namely, edge 47, is left uncovered. Edge 47 will thus provide the base for the next strip laid by mechanism 10.

Figure 2:
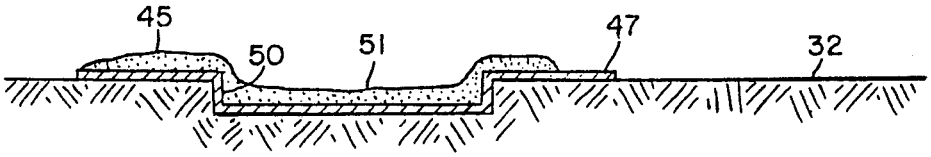
FIG. 2 is a cross-section of the ground taken along the line 2—2 in FIG. 1 during a first pass over a region.

The first manner in which the invention is used is illustrated in FIGS. 2–5, to which reference is now made. FIG. 2 shows the result of making a single pass across a region to be treated, whereby a single groove 50 is scraped in surface 32 by mechanism 10. Soil removed from the groove is temporarily stored in the mechanism as elevator 34 lifts the soil onto spreader 16, which carries the soil over trailing wheel mount 26. Sheet 45, which is unrolled from roll 44, trails out behind the mechanism, covering groove 50. Spreader 16 is designed to distribute soil 51 uniformly deep across the entire width of the strip, as shown in FIG. 9, so that edge 47 remains uncovered. The cross-section of soil 51 matches the cross-section of the groove 50.

Figure 3:
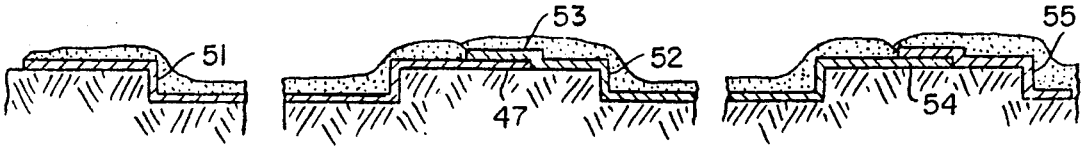
FIGS. 3-5 are other cross-sections through the ground during subsequent passes showing the result of using the apparatus shown in FIG. 1 in accordance with the present invention.

After the mechanism has completed its first pass across the region to be treated, another groove 52 is scraped parallel to first groove 51 by making another pass across the region with mechanism 10. The spacing between the grooves is selected in relation to the width of the strip such that one edge of second strip 53 overlaps uncovered edge 47 of first strip 45. To ensure intimate contact of the overlapped seam between the strips, compressed air may be directed onto edge 47 of the first-laid strip just before second strip 53 contacts the first strip. As in the first pass, soil removed from groove 52 is distributed across the width of the second-laid strip to a uniform depth, as shown in FIG. 3, but one edge 54 remains uncovered. FIG. 9 illustrates successive passes by mechanism 10.

Figure 4:
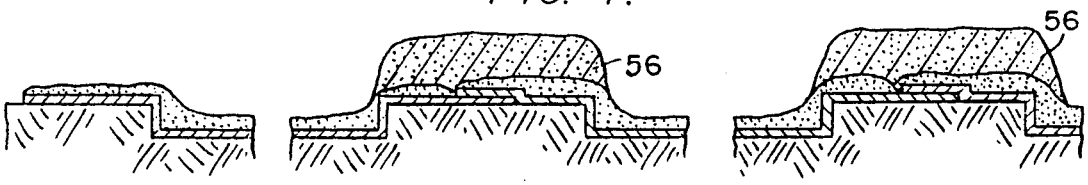

When the pass across the region is completed, mechanism 10 makes a further pass to create further groove 55, as indicated in FIG. 3; the process is repeated until the entire region is covered by overlapping strips of plastic sheet material. As can be seen in FIG. 3, the process described above lays a first layer of impermeable material in terms of individual strips of material that have overlapping edges, and the first layer is uniformly covered with soil. Heavy earth-moving machinery can immediately drive onto the treated region without damaging the sheet material. This permits earth-moving equipment to deposit mounds of earth 56 on top of the overlapping edges of the strips, as shown in FIG. 4. Soil for these mounds can be scraped by mechanism 10, operated in a conventional manner, from areas adjacent the treated area.

Figure 5:
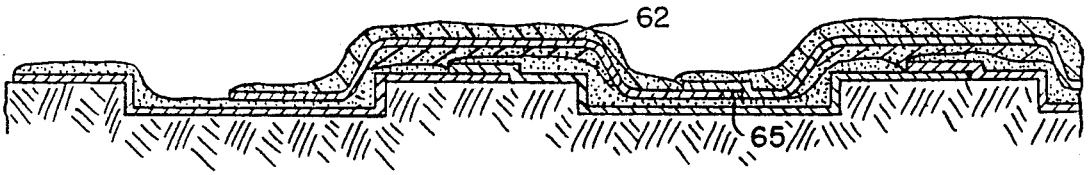

After the mounds have been deposited, as shown in FIG. 4, the process described in connection with FIGS. 2 and 3 can be repeated. That is to say, mechanism 10 can be driven along the mounds so that the scraper blade bites into and removes the upper portion of a mound as another plastic strip 62 is laid over the mound, as shown in FIG. 5. The soil removed from the mound by the elevator is then distributed across strip 62, except for one edge 65, as shown in FIG. 5, in preparation for making another pass by driving the scraper across an adjacent mound and repeating the process.

When the steps described above have been carried out, a region will have been covered by two layers of impermeable material with a layer of soil trapped between the two layers each layer comprising strips of impermeable material that overlap with the overlaps in one layer being staggered with respect to the overlaps in the other layer. This arrangement provides the maximum resistance to leakage of fluid.

A jet of compressed air may be applied to the clear edges of a strip by air line 66, as shown in FIG. 9. This will blow away any particles of soil that may have drifted onto the edge, and will provide a clean surface for the sheet material of the second strip to engage the edge of the first strip. If desired, or if necessary, a bonding agent may be applied behind the jet of air for the purpose of bonding the edges of the strips together.

Figure 6:
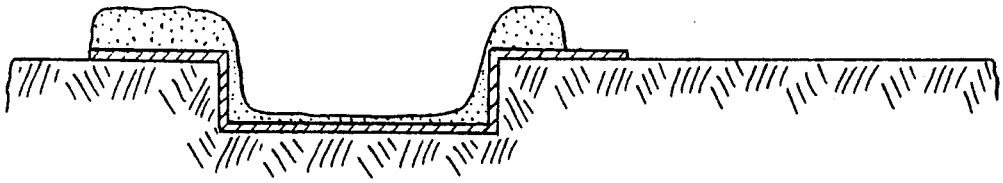
FIG. 6 is similar to FIG. 2, but shows another embodiment of the invention.
Figure 7:
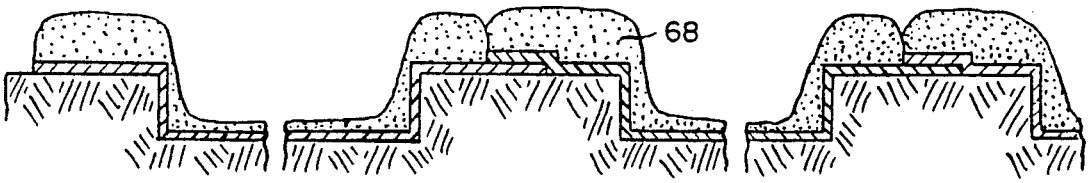
FIG. 7 is the cross-section of FIG. 6, showing the result of using the apparatus of FIG. 1 in accordance with another aspect of the present invention.
Figure 12:
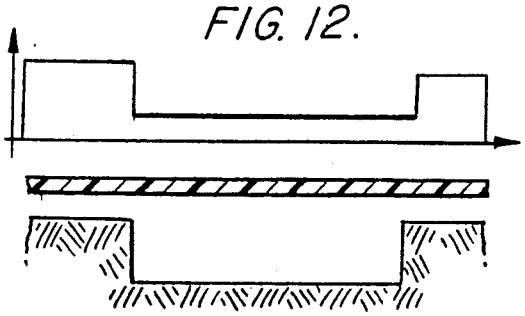
FIG. 12 is a view similar to FIG. 11 for another form of the invention.

The alternative arrangement shown in FIGS. 6 and 7 eliminates the need to create mounds 56 by carting soil from another region, and thus materially speeds up the process of laying down overlying layers. In this alternative arrangement, the depth of the scraper blade is increased over that previously described for the purpose of removing sufficient soil from the groove to provide the mounds. This arrangement is shown in FIGS. 6 and 7, and the function of spreader 16 in this case is to provide the desired widthwise distribution of the soil, as shown in FIG. 12. To achieve this end, spreader 1 may include rotating mechanical spreaders (not shown). After multiple passes over the region have been carried out, the arrangement shown in FIG. 7 will result, and mounds 68 will be similar to mounds 56. Mounds 68, however, are created by the scraping of the grooves without the necessity of the extra step of separately creating the mounds. This procedure thus eliminates one traverse of earth-moving equipment over the plastic sheets, and materially increases the rate at which the bottom of a pond can be constructed.

Figure 8:
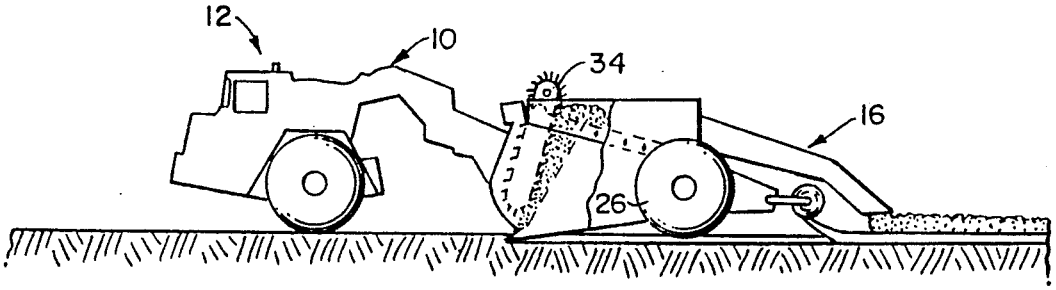
FIG. 8 is a side view of apparatus similar to that of FIG. 1.
Figure 10:
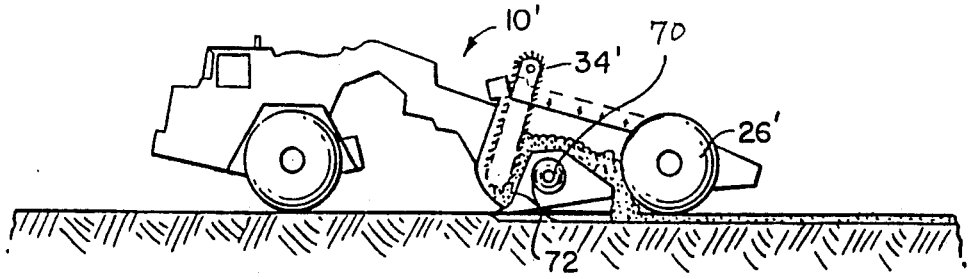
FIG. 10 is a side view of a second embodiment of the present invention.
Figure 11:
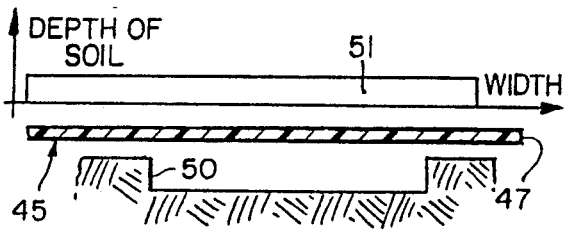
FIG. 11 is a sectional view of a groove showing its relationship to a strip and the distribution pattern of soil for one form of the invention.

Alternative to embodiment 10 shown in. FIGS. 1 and 8, embodiment 10' shown in FIG. 10 can be used. In embodiment 10', roll 70 of sheet material is carried within the bowl of the scraper, and is located forwardly of rear wheel support 26' and rearwardly of elevator 34'. In this case, the spreader is in the form of baffle 72 built over roll 70 for the purpose of providing a path for the soil lifted by elevator 34'. In this case, the soil temporarily stored in the scraper is deposited onto the strip ahead of the rear wheel support, which rides over the deposited soil.

As shown in FIG. 9, roll 44 of plastic material is symmetrically located with respect to the center line of the vehicle; and spreader 16 has its trailing edge eccentrically located relative to the center line It is also possible, however, to eccentrically locate the roll, and to arrange for the trailing edge of the spreader to be symmetrical with respect to the center line.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

I claim:

1. A method for controlling leakage through soil or other granular material in a region comprising the steps of:

(a) passing over the region with a vehicle having a scraper blade for scraping and removing soil therefrom;

(b) sequentially passing over a portion of the region with the vehicle and laying a strip of impermeable sheet material on the ground during each pass such that the vehicle avoids traveling directly on the sheet material on the ground;

(c) depositing soil on the strip such that the latter is covered with soil substantially uniformly deep on the strip except along one edge, the other edge of the strip overlying the uncovered edge of the adjacent previously laid down strip thereby establishing a first layer of overlapping strips of sheet material covered with soil.

2. A method according to claim 1 including the steps of:

(a) using the vehicle to sequentially pass over soil previously deposited over the overlap of adjacent strips and to lay a strip of material thereover during each pass; and (b) depositing soil onto the last mentioned strip such that it is covered with soil except along one edge, the other edge of the strip overlying the uncovered edge of an adjacent previously laid down strip whereby a second layer of overlapping strips of sheet material is laid down over the first layer of overlying sheets of sheet material, the overlaps of the second layer being staggered with respect to the overlaps of the first layer.

3. A method according to claim 2 wherein the first and second layers substantially cover the entire region.

4. A method for controlling fluid leakage through soil or other granular material in a region comprised of steps of:

(a) passing over the region with a vehicle having a scraper blade for scraping and removing soil from the region;

(b) sequentially passing over a portion of the region with the vehicle and laying a strip of impermeable sheet material on the ground during each pass such that the vehicle avoids travelling directly on the sheet material on the ground;

(c) depositing soil previously removed onto the strip such that the latter is covered with soil except along one edge, the other edge of the strip overlying the uncovered edge of an adjacent previously laid down strip thereby establishing a first layer of overlapping strips of sheet material covered with soil;

(d) using the vehicle to sequentially pass over the soil previously deposited over the overlap of adjacent strips and to lay a strip of material thereover during each pass; and (e) depositing soil onto the last mentioned strip such that it is covered with soil except along one edge, the other edge of the strip overlying the uncovered edge of an adjacent previously laid down strip whereby a second layer of overlapping strips of sheet material is laid down over the first layer of overlying strips of sheet material, the overlaps of the second layer being staggered with respect to the overlaps in the first layer.

5. A method according to claim 4 wherein the first and second layer substantially cover the entire region.

6. A method for controlling fluid leakage through soil or other granular material in a region comprising the steps of:

(a) passing over the region with a vehicle having a scraper blade for scraping or removing soil from the region;

(b) sequentially passing over a portion of the region with the vehicle and laying a strip of fluid impermeable sheet material on the ground during each pass, one edge of the strip overlying an uncovered edge of a previously laid down strip thereby establishing a first layer of overlapping strips of sheet material;

(c) depositing removed soil onto said first layer of overlapping strips except along the other edge of the last laid strip;

(d) sequentially driving the vehicle over soil deposited over the overlap of a pair of previously laid adjacent strips and laying a further strip of sheet material during each pass, one edge of said further strip overlapping an uncovered edge of a previously laid down strip of material over soil deposited over an overlap of another pair of adjacent strips thereby establishing a second layer of overlapping strips of sheet material, the overlaps of the second layer being staggered with respect to the overlaps of the first layer; and (e) depositing soil into the second layer of overlapping strips.

7. A method according to claim 6 wherein the first and second layer substantially cover the entire region.

8. A method for controlling leakage through soil or other granular material in a region comprising steps of:

(a) laying a first layer of overlapping strips of impermeable sheets of material on the ground without bonding the overlying strips; and (b) laying a second layer of overlapping strips of impermeable sheets of material over the first layer of strips separated from the first layer of overlapping strips by a layer of soil, the overlaps of the second layer of strips being staggered which with respect to the overlaps of the first layer.

9. A method for controlling fluid leakage through soil or other granular material in a region comprising the steps of:

(a) sequentially passing over the region to dig a plurality of parallel laterally displaced grooves on the surface;

(b) removing the soil from each groove as it is dug;

(c) sequentially passing over the region and laying a strip of impermeable sheet material during each pass over a dug groove, the width of said strip being wider than the periphery of the grooves so that the lateral edges of the strip extend beyond the edges defined by said groove; and (d) depositing soil onto the strip such that the strip is covered with soil except along one edge, the other edge of the strip overlying the uncovered edge of an adjacent previously laid strip thereby establishing a first layer of overlapping strips of sheet material covered with soil. laid down strip thereby establishing a first layer of overlapping strip of sheet material covered with soil.

10. A method according to claim 9 further comprising the step of spreading the earth substantially uniformly on the strip.

11. A method according to claim 9 further comprising the steps of: '(a) sequentially passing over the overlapping portions of the strips in a direction along the length of the strips and laying a strip of sheet material thereover during each pass; and (b) depositing soil onto the last mentioned strips such that it is covered with soil except along one edge, the other edge of the strip overlying the uncovered edge of an adjacent strip laid down during a previous pass whereby a second layer of overlapping strips of sheet material is established on the first layer of overlapping strip of sheet material, the overlaps on the second sheet being staggered with respect to the overlaps of the first layer.

12. A method according to claim 11 wherein the first and second layers substantially cover the entire region.

13. A method for controlling fluid leakage through soil or other granular material in a region comprising the steps of:

(a) sequentially passing over the region to dig a plurality of parallel, laterally spaced, grooves in the surface;

(b) removing the soil from each groove as it is dug;

(c) sequentially passing over the region and laying a strip of impermeable sheet material during each pass over a dug groove, the strip being wider than the periphery of the groove;

(d) depositing soil on the strip such that the strip such that the strip is covered with soil except along one edge, the other edge of the strip overlying the uncovered edge of an adjacent previously laid strip, thereby establishing a first layer of overlapping strips of sheet material covered with soil;

(e) sequentially passing over the overlapping portions of the strips in a direction along the length of the strips and having a strip of sheet material thereover during each pass; and (f) depositing soil onto the last mentioned strip such that it is covered with soil except along one edge, the other edge of the strip overlying the uncovered edge of an adjacent strip laid down during a previously pass whereby a second layer of overlapping strip of sheet material is established overlying the first layer of overlapping strips of sheet material, the overlaps of the second layer being staggered with respect to the overlaps of the first layer.

14. A method according to claim 13 further comprising the step of spreading the earth substantially uniformly on the strip.

15. A method according to claim 13 wherein the first and second layers substantially cover the entire region.

16. Apparatus for treating the surface of the ground in a region with a vehicle having ground engaging means for supporting the same, and means located at the front of the vehicle for digging a groove in the surface each time the vehicle traverses the region and for lifting the earth dug from the current groove onto a sheet of strip material that is laid-out over the current groove from a roll at the back of the vehicle when the latter traverses the region, the improvement being in having the width of the strip, when it is laid-out on the current groove, wider than the width of the ground engaging means of the vehicle, and wider than the periphery of the current groove, in having an edge of a previously laid-out strip free from contact with the ground engaging means when the next groove is dug parallel to the previously dug groove, and in having an edge of the next laid-out on the next groove overlap, said edge of the previously laid-out strip.

17. Apparatus for laying a layer of sheet material below the surface of the ground comprising:

(a) a scraper mechanism having ground engaging means for supporting the mechanism and including a trailing wheel support and a leading scraper blade selectively engagable with the ground for scraping a groove therein each time the mechanism traverses the ground;

(b) a roll of sheet material mounted on said trailing wheel support and being wider than the cross-sectional perimeter of the groove, wider than the mechanism on which the roll is mounted, and wider than the ground engaging means, the axis of rotation of the roll being parallel to the axis of rotation of the trailing wheel support, for depositing a strip of sheet material over a current groove as the groove is created; (c) an elevator separate from the leading scraping blade for raising the scraped soil into a spreader mounted on the mechanism; and (d) the spreader being constructed and arranged to non-uniformly distribute the earth across the width of the strip deposited over the current groove so that one edge of the strip remains uncovered, both said ground engaging means and said trailing wheel support leaving the uncovered edge of a previously deposited strip free from contact when the next groove is scraped parallel to the previously scraped groove, and so that an edge of the next strip deposited on the next groove overlapping the uncovered edge of the previously deposited strip.

* * * * *